US011002523B2

(12) United States Patent
Billings

(10) Patent No.: US 11,002,523 B2
(45) Date of Patent: May 11, 2021

(54) DOUBLE FEED TRAINING CARTRIDGE FOR FIREARMS

(71) Applicant: Chris Lee Billings, Morgan, UT (US)

(72) Inventor: Chris Lee Billings, Morgan, UT (US)

( * ) Notice: Subject to any disclaimer, the term of this patent is extended or adjusted under 35 U.S.C. 154(b) by 583 days.

(21) Appl. No.: 15/914,984

(22) Filed: Mar. 7, 2018

(65) Prior Publication Data

US 2018/0259307 A1 Sep. 13, 2018

Related U.S. Application Data

(60) Provisional application No. 62/468,139, filed on Mar. 7, 2017.

(51) Int. Cl.
*F42B 8/08* (2006.01)
*F41A 33/00* (2006.01)

(52) U.S. Cl.
CPC ..... *F42B 8/08* (2013.01); *F41A 33/00* (2013.01)

(58) Field of Classification Search
USPC ..... 434/24
See application file for complete search history.

(56) References Cited

U.S. PATENT DOCUMENTS

| | | | | |
|---|---|---|---|---|
| 9,423,221 | B2 | 8/2016 | Bonner | |
| 2014/0096427 | A1* | 4/2014 | Bonner | F42B 8/08 42/90 |
| 2017/0363398 | A1 | 12/2017 | Mccloy | |
| 2019/0017788 | A1* | 1/2019 | McCloy | F42B 8/08 |

* cited by examiner

*Primary Examiner* — James B Hull
*Assistant Examiner* — Jennifer L Korb

(57) ABSTRACT

A training cartridge for use in firearm malfunction training is disclosed. The training cartridge is used in a firearm including a clip or magazine to prevent conventional ammunition cartridges from being properly fed into the firing chamber of the firearm. The training cartridge includes a generally cylindrical body, a skirt portion extending outwardly relative to an outer surface of the body, an annular rim spaced from a lower surface of the skirt that is oriented toward the rim such that an annular recess is formed between the lower surface of the skirt and the rim. A feed malfunction is induced when a conventional ammunition cartridge, as it is fed into the firing chamber, is snagged by the adjacent training cartridge.

19 Claims, 4 Drawing Sheets

DOUBLE FEED TRAINING CARTRIDGE FOR FIREARMS

CROSS-REFERENCE TO RELATED APPLICATIONS

This application claims benefit of U.S. Provisional Application 62/468,139 filed on Mar. 7, 2017 and incorporated herein by this reference.

FIELD OF THE INVENTION

The present invention is directed to the field of firearms training and more specifically to training military personnel, police and other individuals how to quickly respond to and correct double feed jamming of rounds or cartridges being introduced toward a firing chamber of firearms including hand guns, rifles and shot guns.

BACKGROUND

Hereinafter the term "firearm" collectively refers to pistols, rifles, automatic weapons, etc. The terms "round" and "cartridge" may be used interchangeably, and "live" or "conventional" ammunition, rounds, and cartridges contain explosive powder and a bullet, whereas a "training" or "dummy" cartridge does not.

In the normal course of training use and operation of a firearm, the trainee is required to perform various exercises so as to become familiar with the performance of the firearm and to familiarize himself with operation of the firearm at different conditions, including unusual conditions and malfunctions and stoppages. Such training improves the skills of the operator so as to anticipate proper functioning in live events, when said operator is under stress and often at unusual and unfamiliar conditions.

Sometimes during use of a firearm which uses ammunition feeding clips or magazines, two rounds or cartridges can become jammed with one another when being fed or forced toward a firing chamber of a firearm. Such jamming may be caused by an improper seating of a cartridge within a clip or magazine, the failure of a feed spring within a clip or magazine, dirt or debris within the clip or magazine, dirt or debris within the firearm, or a defect in the structure of a round or cartridge being fed toward the firing chamber of the firearm. Regardless of the reason, the failure of a firearm to operate properly can be catastrophic for an individual relying on the functionality of the firearm. This is especially true for military and police who may be faced with life threatening circumstances wherein the firearm must be functional.

One type of jamming malfunction is caused by the chambered round of ammunition misfiring, or not firing, leaving a not-completely-discharged round in the chamber that must be cleared out before the weapon can be fired again properly. This first type of malfunction is referred to, for example, as a "Type 1" malfunction", "live trigger stoppage", or "phase-one stoppage".

Another type of malfunction is a "Type 3" malfunction, or "double-feed stoppage," which typically occurs when a round, live or spent, fails to eject from the chamber due, for example, to faulty ammunition or a damaged spent round extractor. In this case, a second round tries to automatically feed into the chamber, but is blocked by the un-ejected round. The spring pressure on the firearm's self-loading mechanism, to push the second round forward into firing position, pushes the front of the second round against the back of the un-ejected first round, and jams and disables the firearm. In order to clear the jammed firearm, the shooter must forcibly remove the magazine, manually remove both the un-ejected and blocked rounds, and ensure that both the chamber and magazine well are clear. Then, the shooter may insert a loaded magazine, and cycle the loading mechanism to result in a live round in the chamber, ready to fire.

Unfortunately, simply being taught how to clear a jam of ammunition in a firearm does not teach someone how to immediately react when a jam occurs. It is possible that some personnel may never experience a jamming event during normal firearms training and thus such personnel will not react as naturally and as quickly as someone who has been trained, through actual experience, how to quickly clear a jam of ammunition in a firearm. Accordingly, it is beneficial to provide training in a live-fire exercise. One particular type of exercise involves introducing a blank round into a magazine, clip, etc. Such a round may be introduced randomly among live ammunition whereby an attempt to fire such a round will unexpectedly generate an ammunition-related stoppage requiring the operator to rapidly react and overcome the stoppage and act according to the respective procedures.

U.S. Pat. No. 9,423,221 to Bonner describes a malfunction training dummy round for use in live fire training and simulation of firearm malfunctions. The dummy round includes voids or channels along the length of the round that interact with various parts of the firearm or magazine, or interface with adjacent live rounds in the magazine assembly, to prevent proper orientation or movement of the dummy round and simulate various malfunctions. Unlike the longitudinal voids and channels of Bonner, the training cartridge disclosed herein has an annular recess that engages the rim/base of an adjacent live round to induce a feed malfunction.

U.S. Patent Publication 2017/0363398 to McCloy describes a malfunction round that has a front end portion that is oversized in diameter and does not fit properly or fully through the firearm breech, to jam the firearm loading mechanism at the breech. When the malfunction round reaches the top of the magazine, the oversized nature of its front end does not fit properly or entirely through the breech, and therefore, does not fit properly or entirely in the chamber as would live round. Further, this malfunction round is designed to not interfere with or snag live rounds, and the jam is caused by the malfunction round itself stopping at, or partially in, the breech. Unlike the malfunction round of McCloy, the training cartridge disclosed herein is adapted to catch or snag an adjacent live round as the live round is being fed from the top of the magazine, causing a double-feed malfunction.

Therefore, the present invention provides a unique structure and operation that realistically simulates a feed malfunction in a firearm in the manner that is different from the existing technology, and is advantageous to the field of firearm malfunction training and preparedness for police officers, military personnel, and the like.

SUMMARY OF THE INVENTION

The present invention is useful for training with firearms wherein the feed of rounds is manual from a clip or magazine, or automatic from a clip or magazine, of a firearm during a natural functioning of the firearm. In accordance with the invention specially designed rounds or cartridges are provided within a conventional feed clip or magazine which will automatically jam with a conventional round or cartridge which is being fed into a firing chamber just ahead of the jamming training round so that the jamming training round must be removed and the jammed conventional round seated within the firing chamber before the firearm can be operable to discharge the conventional round.

Although, training courses are provided that teach personnel how to clear jams in firearms due to ammunition jamming, it is proposed in accordance with the present invention to create truly life like situations wherein firearms will become jammed during firearm training such that the jam must be quickly and effectively cleared in order to continue use of the firearm. To insure that a trainee's firearm will jam during use, it is proposed to place specially designed jamming cartridges, at random positions within training magazines or clips. In this manner, personnel are assured of learning how to react to clear ammunition jams and make a firearm function again as quickly and as naturally as possible. Repetition will result in faster and more accurate responses to firearm jams. By insuring repeated jamming occurrences in firearms training, the reaction skills of the trainees will be maximized.

To insure jamming of ammunition from clips or magazines, specially configured double feed training rounds or cartridges are placed randomly in training clips or magazines. The training rounds will be configured similarly to conventional rounds within a clip or magazine and may include a front end which may be rounded or pointed in the shape of a conventional bullet and a rear end annular rim. In a conventional round or cartridge, an annular recess is formed between the rim and a tubular casing portion of the cartridge. However, with the training round or cartridge the indent which may be formed as a groove, cut out, depressed, or recessed area that will not directly intersect with the walls of a cylinder outer housing or casing but, rather, will intersect with a circular outwardly extending skirt portion. The skirt portion has a lower catch surface that extends outwardly and generally perpendicular relative to a central axis of the training round to an outer annular edge. The skirt has an inwardly tapering upper wall that extends upwardly toward an intersection with the cylindrical outer casing of the training round.

In order to make the training round compatible for loading with conventional rounds or cartridges within clips or magazines, the lower catch surface of the training round is of equal diameter to the cylindrical wall of the conventional round, however, the inwardly tapering upper wall of the skirt and a portion of the cylindrical casing of the training round is of smaller diameter than the conventional round. An upper portion of the cylindrical casing of the training round is of generally equal diameter when compared to the diameter of the cylindrical casing of the conventional round. In this manner, the dimension of the rim, lower edge of the skirt and the upper portion of the cylindrical casing of the training round will align the training round with adjacent conventional rounds within an ammunition clip or magazine.

In use, when a training magazine is mounted to a firearm, when a conventional round, adjacent to a training round, is being fed from the magazine into the firing chamber, the rim of the conventional round will be forced into the annular recess of the training round as a lower portion of the cylindrical casing of the conventional round slides along the skirt of the training round due to the inwardly tapered lower portion of the casing of the training round, at which point, the rim of the conventional round will abut against the catch surface of the skirt of the training round and will thus pull the training round toward the firing chamber of the firearm, thereby jamming the conventional round and preventing proper seating of the conventional round within the firing chamber. The clip or magazine must thereafter be removed and the jam corrected before the firearm can be fired.

In embodiments of the invention, the size, diameter and configuration of the skirt of the training round will complementary fit within the recess of an adjacent conventional live round to ensure that the two rounds will jam as the conventional live round is being urged toward the firing chamber of a firearm. The training round contains no actual bullet nor explosive material and may be integrally molded or formed of a plastic or metal material.

One embodiment of the invention is directed to a training cartridge, for inclusion with live ammunition cartridges in a magazine of a firearm, which is operable to prevent an adjacent live cartridge from correctly feeding into a firing chamber of the firearm, the training cartridge having a longitudinal axis. The training cartridge includes a conical nose at a front of the training cartridge, an annular rim at a rear end of the training cartridge, an inwardly tapering body extending from the conical nose to an outwardly flared annular skirt, and a catch wall extending from said annular skirt, said catch wall being separated from the annular rim by an annular recess.

The training cartridge may have a generally cylindrical body having dimensions substantially conforming to those of a live cartridge that is fired from said firearm. The skirt portion of the training cartridge may be configured to cooperatively seat within an annular recess of an adjacent live cartridge such that the live cartridge is snagged as the cartridge is being moved longitudinally along and adjacent to the training cartridge. The training cartridge may be configured such that, during operation of the firearm, a rim of a live cartridge being fed into the firing chamber is forced inwardly of the annular recess by the annular skirt, and the annular skirt may be configured to seat within an annular recess the live cartridge such that the rim of the live cartridge engages the catch wall, thereby catching the rim of the live cartridge such that the live cartridge cannot feed into the firing chamber of the firearm. The skirt portion has an outer edge portion that is spaced equal distance from a central axis of the generally cylindrical body as an outer annular surface of the annular rim. The generally cylindrical body tapers inwardly from a front end of the body toward the skirt.

Another embodiment of the invention is directed to a training cartridge for use in firearms including a clip or magazine for retaining conventional ammunition cartridges to be fed to a firing chamber of a firearm. The training cartridge includes a generally cylindrical body, a skirt portion extending outwardly relative to an outer surface of the body, an annular rim spaced from a lower surface of the skirt that is oriented toward the rim such that an annular recess is formed between the lower surface of the skirt and the rim.

The skirt portion may have an outer edge portion that is spaced equal distance from a central axis of the generally cylindrical body as an outer annular surface of the annular rim. The generally cylindrical body tapers inwardly from a front end of the body toward the skirt. The training cartridge may be integrally formed. A magazine for retaining and feeding rounds of ammunition to a firing chamber of a firearm may include at least one training cartridge of the present invention.

Still another embodiment of the invention is directed to a method of training a user of a firearm having a magazine for feeding ammunition to a firing chamber of the firearm how to clear ammunition jams that may occur during use of the firearm. The method includes the steps of placing a plurality of conventional ammunition cartridges into the magazine together with at least one training cartridge, wherein one of the conventional ammunition cartridges is placed immediately above and in contact with the at least one training cartridge, inserting the magazine within the firearm, firing the firearm until the at least one training cartridge jams with the one conventional ammunition cartridge, and thereafter, removing the magazine and clearing the jam by removing the at least one training cartridge from the magazine, wherein the training cartridge comprises a generally cylindrical body, a skirt portion extending outwardly relative to an outer surface of the body, an annular rim spaced from a lower surface of the skirt that is oriented toward the rim such that an annular recess is formed between the lower surface of the skirt and the rim.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DESCRIPTION OF THE PREFERRED EMBODIMENTS

Figure 1:
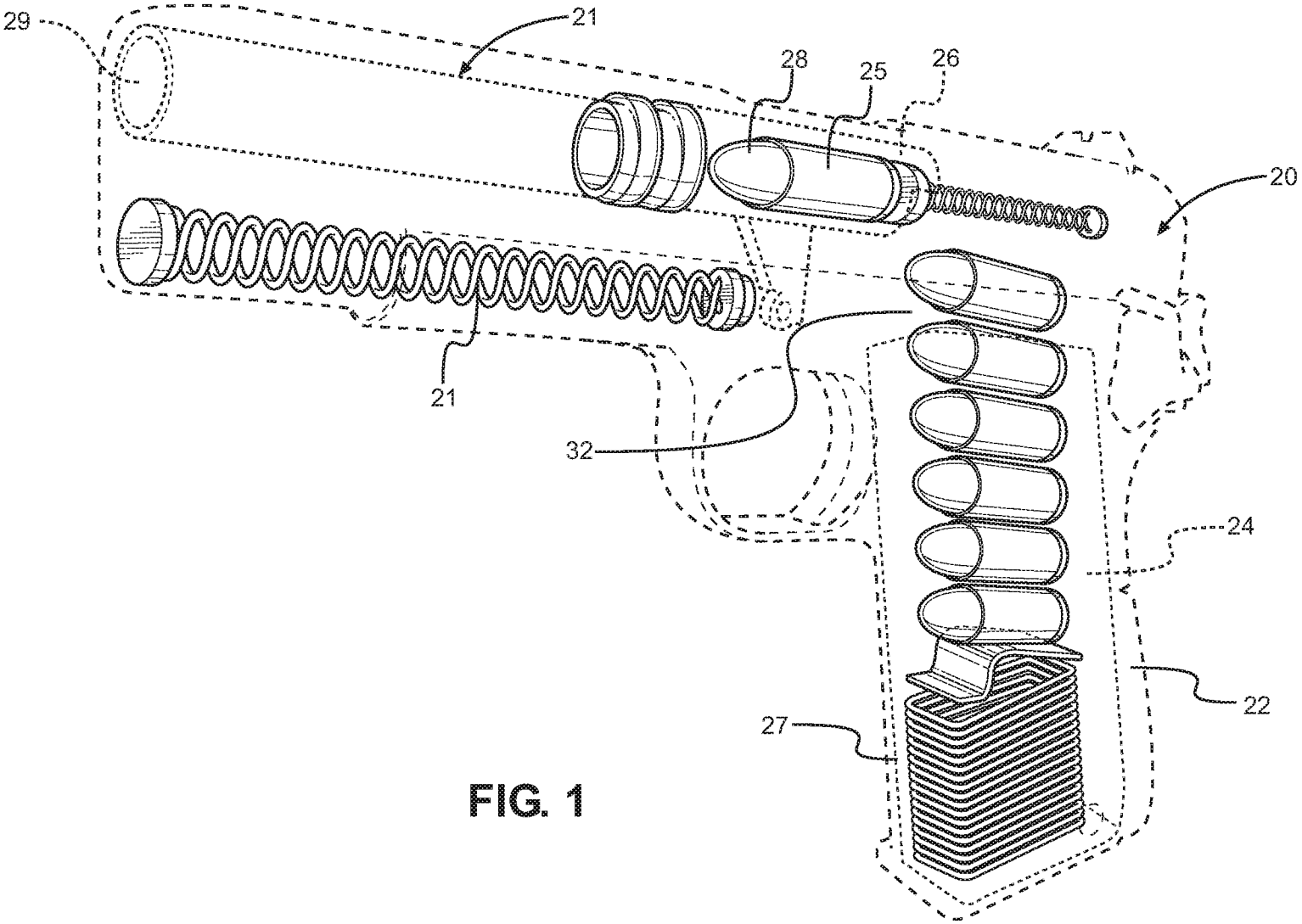
FIG. 1 is an illustrational perspective view of a firearm in a form of a pistol having portions broken away to show an ammunition magazine mounted within a pistol grip and showing a conventional cartridge or round being urged from the magazine into a firing chamber by a spring loaded injector assembly and wherein at least one of the cartridges is actually a double feed training round in accordance with the invention.

Embodiments will be described in detail with reference to the accompanying drawings. The inventive concepts, however, may be embodied in various different forms, and should not be construed as being limited only to the illustrated embodiments. Rather, these embodiments are provided as examples so that this disclosure will be thorough and complete, and will fully convey the inventive concepts to those skilled in the art. Accordingly, because known processes, elements, and techniques are known by those of skill in the art, they are not always described with respect to some of the embodiments. Unless otherwise noted, like reference numerals denote like elements throughout the attached drawings and written description, and thus descriptions will not be repeated.

Unless otherwise defined, all terms (including technical and scientific terms) used herein have the same meaning as commonly understood by one of ordinary skill in the art to which this inventive disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Referring to the Figures, there is shown an exemplary conventional semi-automatic pistol, which is one but not the only firearm with which the disclosed malfunction rounds may be used. Also referring to the Figures, there are shown exemplary live ammunition rounds according to the prior art and embodiments of the dummy round according to the invention. In the following description, the terms "round" and "cartridge" are used interchangeably and synonymously, and particularly the terms "conventional round" and "conventional cartridge" are used interchangeably and synonymously to refer to a traditional live round of ammunition. The so-called "dummy round" is also referred to herein as "malfunction round" or "dummy cartridge" synonymously and interchangeably, and also a "blank" in view of the dummy round preferably comprising no powder or primer or any means of ignition or explosion associated with the dummy round.

The present invention has been developed in response to the present state of the art, and in particular, in response to the problems and needs in the state the art that have not yet been fully solved existing firearm malfunction training aids. In accordance with the invention as embodied and broadly described herein in the embodiments, dummy round or cartridge is provided for initiating jam in the magazine feed of a firearm. The present invention is the long awaited solution to many of the inherent problems and difficulties in firearm malfunction resolution training by allowing additional malfunction types to be simulated in a realistic manner during live fire training.

As previously described, the purpose of the present invention is to educate a user of a firearm how to quickly and efficiently clear a jam in a feed of a round or cartridge of ammunition from a magazine to the firing chamber of a firearm. To accomplish this result, it is necessary to ensure that the firearm will jam, as such occurrences are not frequent in well maintained firearms. With the teachings of the present invention, specially configured rounds of ammunition are placed within training magazines that will create a jam in the feed of ammunition from the magazine to the firing chamber of a firearm without the user knowing in advance when the jam will occur and thus requiring the user to learn how to clear the jam before the firearm can be used to discharge another round of ammunition.

In accordance with the invention, the training rounds of the invention are generally configured as conventional rounds of ammunition of the same caliber to be used in a conventional magazine for introducing the specific caliber of ammunition into a firing chamber of a conventional or specialized firearm. The magazine may be of the type which automatically feeds rounds of ammunition into the firing chamber or of the type that feeds rounds from the magazine into the chamber upon action of the user to cause a round to be fed from the magazine into the firing chamber. The training rounds are different than conventional rounds in that an outwardly extending and downwardly tapering annular skirt is formed in the shell casing or body of the training rounds of ammunition spaced from the base or rim of the training round such that an annular slot or groove is formed between an outer annular wall of the skirt and the rim. The annular slot is of a size to cooperatively receive the rim of a conventional cartridge or round of ammunition as such conventional round is moved longitudinally relative to the training cartridge or round as the conventional round is being fed from a magazine toward a firing chamber of a firearm.

With reference to FIG. 1, a first type or style of handgun 20 is shown which includes a barrel 21, hand grip 22 in which ammunition magazine or clip 24 is housed for feeding cartridges 25 into a firing chamber 26 of the handgun. The magazine is designed and configured to urge a single column of cartridges toward the firing chamber, by way of a spring assembly 27, wherein a loaded conventional cartridge 25 is retained for firing a bullet 28 through a bore 29 of the barrel 21. In accordance with the invention, at least one of the cartridges is actually a special training round 30, see FIGS. 3-5, which is configured to create a jam in a passage 32 between the upper portion of the magazine and the firing chamber to thereby prevent a cartridge immediately above the training round from properly seating within the firing chamber. The details of the double feed training round will be described with respect to FIG. 5.

Figure 2:
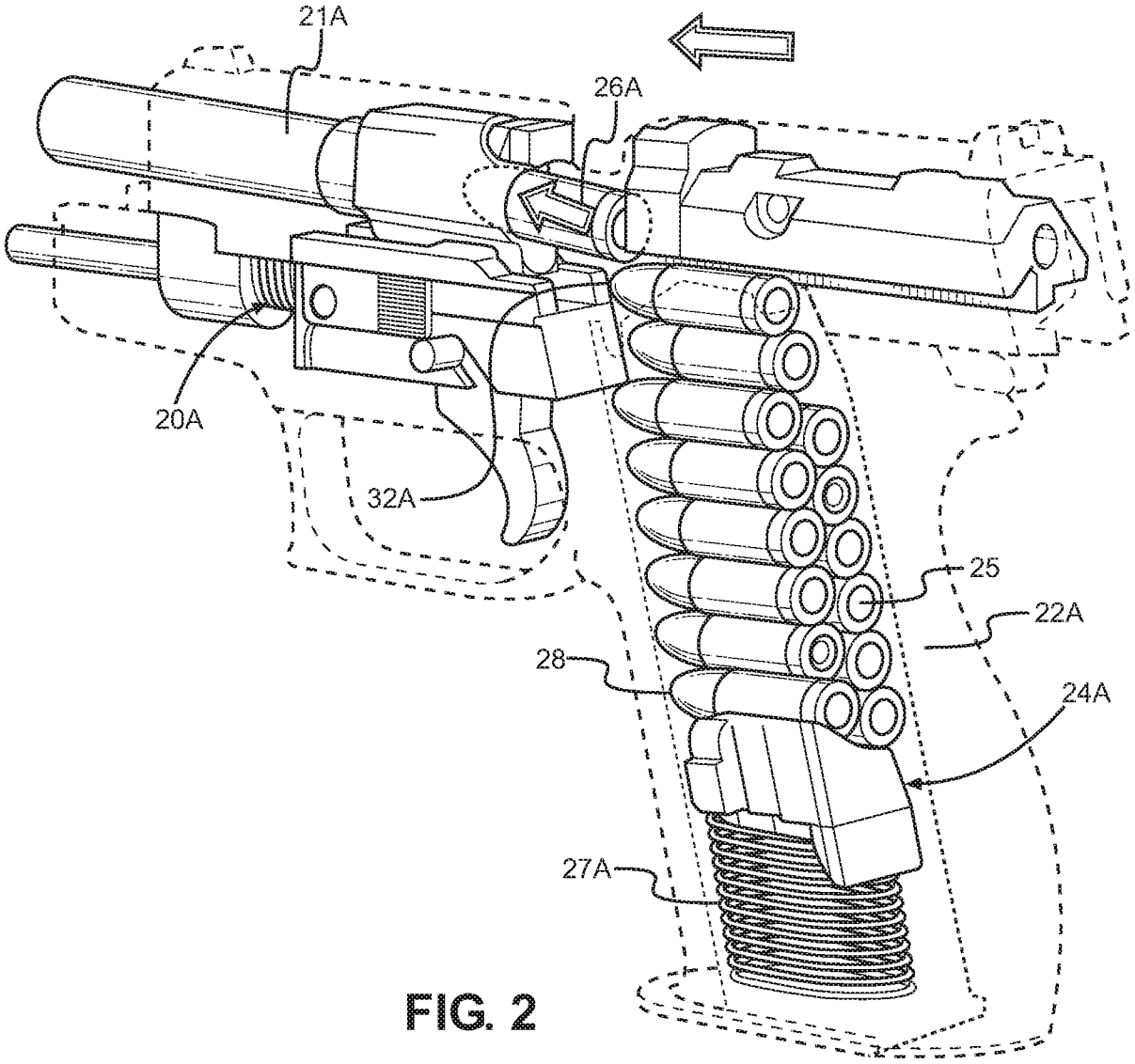
FIG. 2 is an illustrational perspective view of a different type of firearm having portions broken away to show a conventional cartridge as loaded into a firing chamber and with the convention cartridges and at least one double feed training round being fed from a second style of magazine.

With reference to FIG. 2, a second type or style of handgun 20A is shown which includes a barrel 21A, hand grip 22A in which an ammunition magazine 24A is housed for feeding conventional cartridges 25 into a firing chamber 26A of the handgun. The magazine is designed and configured to urge a double column of cartridges toward the firing chamber, by way of a spring assembly 27A, wherein a loaded cartridge 25 is retained for firing a bullet 28 of the cartridge 25 through a bore of the barrel 21A. In accordance with the invention, at least one of the cartridges is actually a special training round 30 which is configured to create a jam in a passage 32A between the upper portion of the magazine and the firing chamber to thereby prevent a conventional cartridge immediately above the training round from properly seating within the firing chamber. The details of the double feed training round will be described with respect to FIGS. 3-5.

Figure 3:
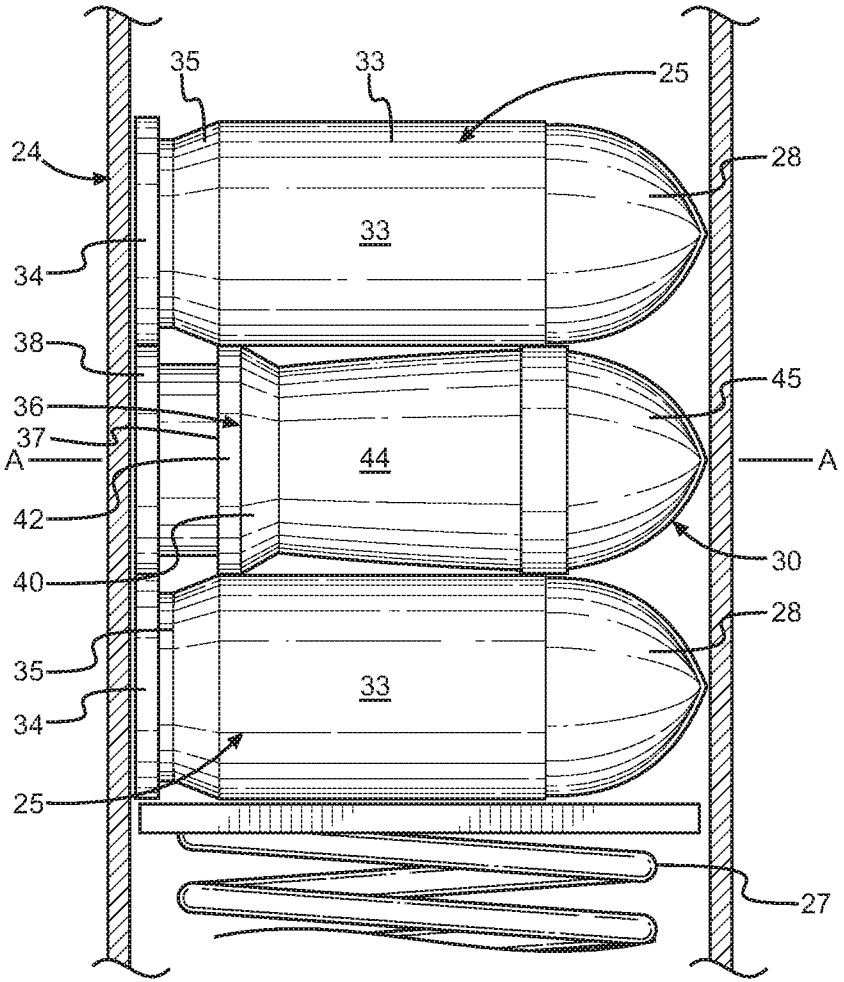
FIG. 3 is an enlarged illustrational view having portions broken away of a magazine such as shown in FIG. 1 showing one of the training rounds of the present invention positioned between upper and lower conventional live rounds within the magazine prior to the upper round being injected toward a firing chamber of a firearm.

With reference to FIG. 3, a portion of the magazine 24 of FIG. 1 is shown having portions broken away to show upper and lower conventional live rounds or cartridges 25 of ammunition placed on opposite sides of a double feed training round or cartridge 30, which is not a live round. The conventional rounds of ammunition include a generally conical bullet 28, a cylindrical casing 33 that tapers inwardly toward an end rim 34 thereby defining an annular recess 35. The double feed training round 30 is shaped somewhat similar to the convention round of ammunition so that when placed within the magazine 24 or 24A, the conventional and training rounds are aligned with the cartridge rims and upper shell casings engaged with one another, as is shown in FIG. 3.

Figure 4:
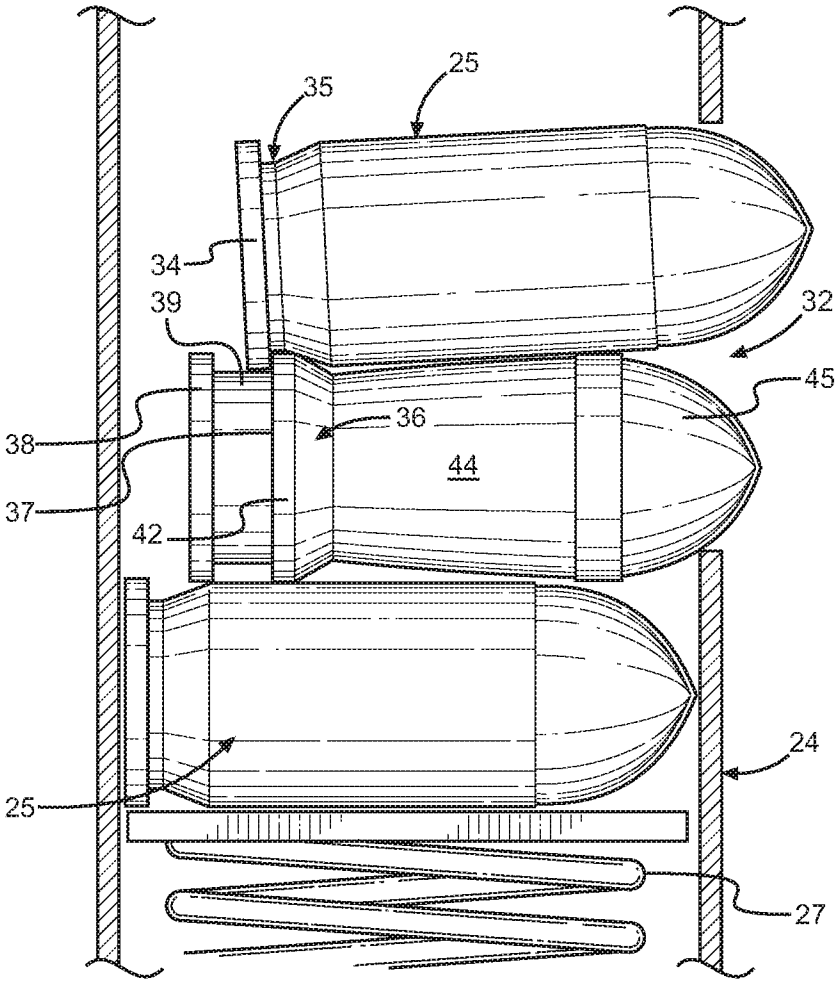
FIG. 4 is partial enlarged illustrational view similar to FIG. 3 showing one of the training rounds of the present invention engaging and interlocking with an upper conventional round to thereby prevent the conventional round from entering the firing chamber and thus jamming the firearm and preventing the firing of the conventional round.
Figure 5:
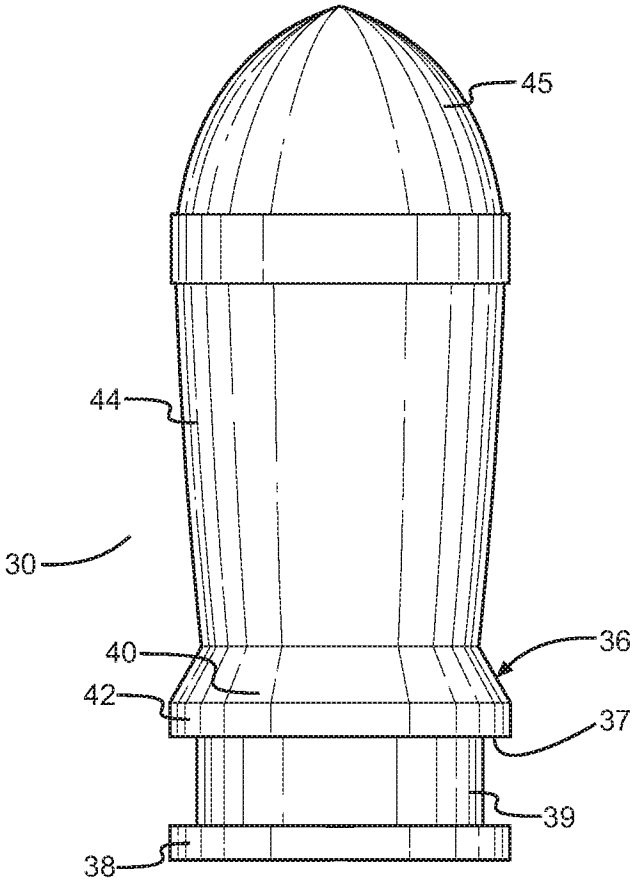
FIG. 5 is a perspective view of a training round or cartridge of the present invention.

However, and as shown in FIGS. 4 and 5, the training round is configured to trap or snag the upper conventional cartridge as it is being fed from the magazine toward the firing chamber of the firearm. To accomplish this, the training round or cartridge 30 includes an inwardly tapering shell casing 44 that extends from a conical bullet shaped end 45 to an outwardly flared annular skirt 36 that defines an inwardly extending catch wall 37 that is spaced from an annular rim 38 of the training cartridge 30. The catch wall of the skirt is spaced from the rim 38 of the training cartridge by an annular recess 39. When the feed mechanism of the magazine begins to force the conventional cartridge 25 toward the firing chamber of a firearm, the rim 34 of the convention cartridge 25 is forced inwardly of the recess 39 by the upper tapered surface 40 of the skirt 36 of the training cartridge 30. The annular outer edge 42 of the skirt 34 slides within the annular recess 35 of the conventional cartridge 25 until the rim 34 of the conventional cartridge engages the catch wall 37 of the skirt which traps the rim 34 so that the cartridge 25 cannot move toward the firing chamber of the firearm, thus causing a jamming of the feed of ammunition from the magazine to the firing chamber of the firearm. For the user of the firearm to continue use of the firearm, the user must first clear the jam by removing the magazine and clearing out the training round 30. By repeating the clearance of jammed rounds through repeated use of ammunition clips or magazines including one or more double feed training cartridges 30, the user will learn to be very proficient in removing jammed ammunition from a firearm.

As shown in FIG. 4, the sloped upper wall or surface 40 of the skirt 36 of the double feed training rounds or cartridges 30 is preferably shaped to cooperatively seat within the annular recess 35 of a conventional cartridge to thereby ensure the trapping of a conventional cartridge whenever such a cartridge is being moved longitudinally along and adjacent a double feed training cartridge. Also, the outer edge 42 of the skirt 36 should preferably extend outward relative to a centerline or central axis A-A of the body of the training cartridge 30 to the same distance that the rim 38 extends from the same axis to ensure proper alignment of cartridges 25 and training cartridges 30 within the ammunition magazine 24 as shown in FIG. 3.

As the training cartridges 30 of the present invention are not to fire a bullet, they will not contain any explosive powder nor a releasable bullet and thus they may be made of substantially any material including plastics or metal. In some embodiments, the training cartridges may be integrally molded such as from a plastic material. However, the material must be sufficiently strong enough to overcome the force of a feed spring or assembly of a firearm that feeds ammunition cartridges from an ammunition magazine to the firing chamber of a firearm.

Each conventional cartridge 25 and each training cartridge 30 operates properly in the magazine 24, fitting properly in, and moving smoothly along the length of the magazine 24 without interfering with the higher-up or lower-down cartridges in the magazine. For training, one or more of the training cartridges 30 will be stacked with conventional cartridges 24, with the order of stacking in the magazine being determined by the trainer.

While specific calibers of practice rounds have been shown, it will be appreciated that this is for purposes of illustration only, and that the principles of the present invention are applicable to any desired caliber.

It is to be understood that the disclosure of the invention in this specification includes all possible combinations of such particular features. For example, where a particular feature is disclosed in the context of a particular aspect, a particular embodiment, or a particular Figure, that feature can also be used, to the extent appropriate, in the context of other particular aspects, embodiments, and Figures, and in the invention generally. Although this invention has been described above with reference to particular means, materials, and embodiments, it is to be understood that the invention is not limited to these disclosed particulars, but extends instead to all equivalents within the broad scope of this disclosure and the scope of the following claims.

I claim:

1. A training cartridge, for inclusion with an adjacent live ammunition cartridge in a magazine of a firearm, operable to prevent the adjacent live ammunition cartridge from correctly feeding into a firing chamber of the firearm, the training cartridge having a longitudinal axis, the training cartridge comprising:

a conical nose at a front of the training cartridge;

an annular rim at a rear end of the training cartridge;

an inwardly tapering body extending from the conical nose to an outwardly flared annular skirt; and a catch wall extending from said annular skirt, said catch wall being separated from the annular rim by an annular recess.

2. The training cartridge of claim 1, wherein the training cartridge has a cylindrical body having dimensions conforming to those of the adjacent live ammunition cartridge, such that the training cartridge sits in the magazine in a same manner as the adjacent live ammunition cartridge.

3. The training cartridge of claim 1, wherein the skirt portion of the training cartridge is configured to cooperatively seat within an annular recess of the adjacent live ammunition cartridge such that the adjacent live ammunition cartridge is snagged as the adjacent live ammunition cartridge is moved longitudinally along and adjacent to the training cartridge.

4. The training cartridge of claim 1, wherein the training cartridge is configured such that, during operation of the firearm, a rim of a live cartridge being fed into the firing chamber is forced inwardly of the annular recess by the annular skirt.

5. The training cartridge of claim 4, wherein the annular skirt is configured to seat within an annular recess of the live cartridge such that the rim of the live cartridge engages the catch wall, thereby catching the rim of the live cartridge such that the live cartridge cannot feed into the firing chamber of the firearm.

6. The training cartridge of claim 1, wherein the skirt portion has an outer edge portion that is spaced equal distance from a central axis of the generally cylindrical body as an outer annular surface of the annular rim.

7. A training cartridge for use in firearms including a clip or magazine for retaining conventional ammunition cartridges to be fed to a firing chamber of a firearm, the training cartridge comprising a cylindrical body, a skirt portion extending outwardly relative to an outer surface of the body, an annular rim spaced from a lower surface of the skirt that is oriented toward the rim such that an annular recess is formed between the lower surface of the skirt and the rim.

8. The training cartridge of claim 7, wherein the skirt portion has an outer edge portion that is spaced equal distance from a central axis of the cylindrical body as an outer annular surface of the annular rim.

9. The training cartridge of claim 7, wherein the cylindrical body tapers inwardly from a front end of the body toward the skirt.

10. The training cartridge of claim 7, wherein the training cartridge is integrally formed.

11. The training cartridge of claim 7, wherein the front of the body includes a conical portion extending therefrom.

12. A magazine for retaining and feeding rounds of ammunition to a firing chamber of a firearm, the magazine including at least one training cartridge as defined in claim 7.

13. A method of training a user of a firearm having a magazine for feeding ammunition to a firing chamber of the firearm how to clear ammunition jams that may occur during use of the firearm, the method comprising the steps of:

placing a plurality of conventional ammunition cartridges into the magazine together with at least one training cartridge, wherein one of the conventional ammunition cartridges is placed immediately above and in contact with the at least one training cartridge;

inserting the magazine within the firearm;

firing the firearm until the at least one training cartridge jams with the one conventional ammunition cartridge; and thereafter, removing the magazine and clearing the jam by removing the at least one training cartridge from the magazine, wherein the training cartridge comprises a cylindrical body, a skirt portion extending outwardly relative to an outer surface of the body, an annular rim spaced from a lower surface of the skirt that is oriented toward the rim such that an annular recess is formed between the lower surface of the skirt and the rim.

14. The method of claim 13, wherein the training cartridge is configured such that, during operation of the firearm, a rim of a live cartridge being fed into the firing chamber is forced inwardly of the annular recess by the skirt.

15. The method of claim 14, wherein the skirt is configured to seat within an annular recess the live cartridge such that the rim of the live cartridge engages a catch wall, thereby catching the rim of the live cartridge such that the live cartridge cannot feed into the firing chamber of the firearm.

16. The training cartridge of claim 1, wherein the training cartridge does not contain explosive powder.

17. The training cartridge of claim 1, wherein the training cartridge does not include a releasable bullet.

18. The training cartridge of claim 7, wherein the training cartridge does not contain explosive powder.

19. The training cartridge of claim 7, wherein the training cartridge does not include a releasable bullet.

* * * * *